US005365683A

United States Patent [19]

Borja

[11] Patent Number: 5,365,683

[45] Date of Patent: Nov. 22, 1994

[54] SPORTS CARD DISPLAY STAND

[75] Inventor: Javier Borja, Denver, Colo.

[73] Assignees: Gary A. Dahyl; Jeffrey H. Anderson, both of Denver, Colo.

[21] Appl. No.: 905,272

[22] Filed: Jun. 26, 1992

[51] Int. Cl.[5] ..... A47G 1/00

[52] U.S. Cl. ..... 40/152.1; 40/358

[58] Field of Search ..... 40/152.1, 152, 358

[56] References Cited

U.S. PATENT DOCUMENTS

| | | | |
|---|---|---|---|
| D. 158,699 | 5/1950 | Wasilevich | D30/9 |
| D. 233,500 | 11/1974 | Phillirs | D6/239 |
| D. 314,162 | 1/1991 | Long | D11/131 |
| D. 317,530 | 6/1991 | Masterson | D6/303 |
| 1,857,423 | 5/1932 | Zadek | 40/152.1 |
| 2,227,152 | 12/1940 | Pidot | 40/152.1 |
| 2,504,375 | 4/1950 | Barbieri | 40/152.1 |
| 2,541,600 | 2/1951 | Nelson | 40/152.1 |
| 2,968,109 | 1/1961 | Timmins | 40/152.1 |
| 3,624,939 | 12/1971 | Gossard | 40/10 |
| 3,978,631 | 9/1976 | Diersing | 40/152.1 |
| 4,019,269 | 4/1977 | Vix | 40/19 |
| 4,144,664 | 3/1979 | DeKorte | 40/661 X |
| 4,459,772 | 7/1984 | Kanzelberger | 40/152.1 |
| 4,530,863 | 7/1985 | Seeger | 428/13 |
| 4,807,377 | 2/1989 | Stuckel | 40/152.1 |
| 4,944,968 | 7/1990 | Wagner | 428/13 |
| 4,979,619 | 12/1990 | Hager | 206/509 |

FOREIGN PATENT DOCUMENTS

| | | | |
|---|---|---|---|
| 689508 | 9/1930 | France | 40/152.1 |
| 3974 | of 1894 | United Kingdom | 40/358 |

*Primary Examiner*—Kenneth J. Dorner
*Assistant Examiner*—Cassandra Davis
*Attorney, Agent, or Firm*—John R. Flanagan

[57] ABSTRACT

A sports card display stand includes a platform-like base, at least a pair of support posts mounted upright and laterally-spaced apart on the base, a longitudinal groove extending between upper and lower ends of each support post and facing toward one another for slidably receiving an article holder in the form of a flat plastic sleeve containing a sports card or photo between each pair of the posts with opposite longitudinal edges of the sleeve extending within the grooves, and an elongated narrow top cap member having spaced cavities and a longitudinal channel extending between and intersecting with the cavities being recessed in an underside of the top cap member for receiving in a releasable mated relationship the upper ends of the support posts and the upper edge of the flat plastic sleeve in order to removably mount the top cap member onto the upper ends of the support posts. In such arrangement, the top cap member, base and support posts together form a frame which completely encloses the periphery of the flat plastic sleeve containing the sports card or photo. Removal of the top cap member from the posts permits withdrawal and replacement of the flat plastic sleeve containing the sports card or photo from and into the grooves of the posts.

8 Claims, 2 Drawing Sheets

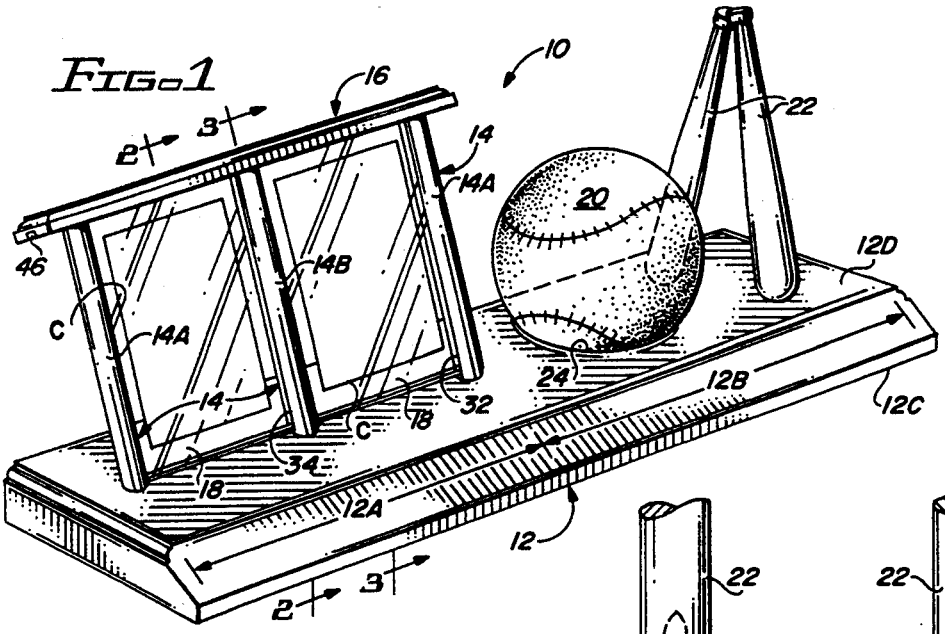
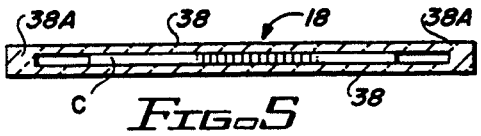
FIG. 5
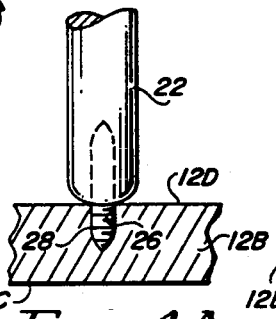
FIG. 4A
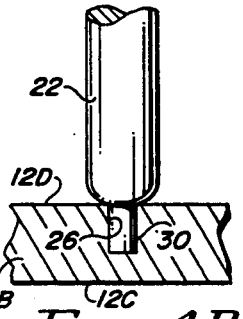
FIG. 4B
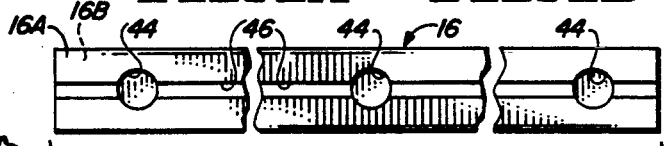
FIG. 6
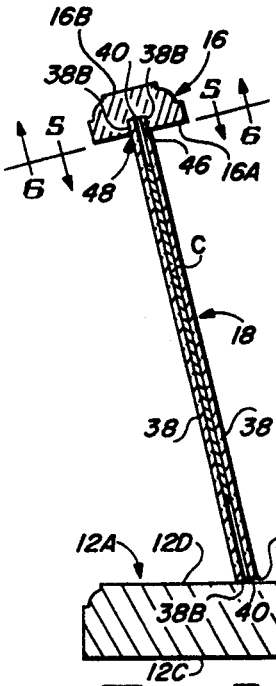
FIG. 2
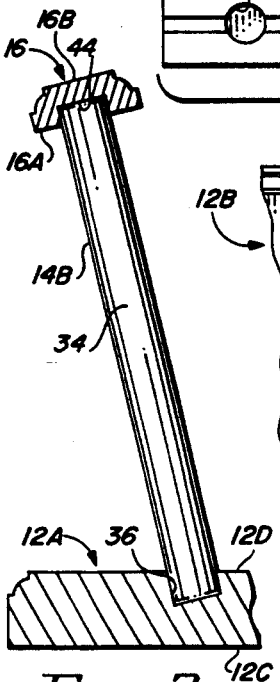
FIG. 3
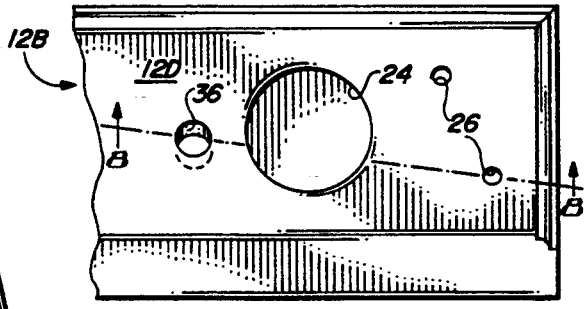
FIG. 7
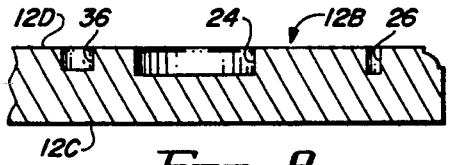
FIG. 8

SPORTS CARD DISPLAY STAND

BACKGROUND OF THE INVENTION

1. Field of the Invention

The present invention generally relates to displays and trophies and, more particularly, is concerned with a sports card display stand for storing, displaying and protecting special and rare cards and photos, especially cards and photos of individuals participating in sports.

2. Description of the Prior Art

It is common practice for persons to display a wide variety of articles in their homes and offices. With regard to young people participating in sports, typically parents will display photographs of their children while engaged in sports or just wearing the particular sports uniform and maybe holding the bat, ball, glove or club of the particular sport. Additionally, many sports-minded children and adults purchase, collect and trade small cards bearing photos of sports figures. The most favorite or valuable ones may be chosen for display.

Displays and trophies of a wide variety of designs and constructions are known in the prior patent art for displaying cards and photos. Representative examples are the devices disclosed in prior art U.S. Pat. Nos. issued to Barbieri (2,504,375), Nelson (2,541,600), Timmins (2,968,109), Gossard (3,624,939), Vix (4,019,269), Seeger (4,530,863), Wagner (4,944,968) and Hager (4,979,619), and in prior art U.S. design Pat. Nos. issued to Wasilevich (158,699), Phillips (233,500), Farley (237,933), Long (314,162) and Masterson (317,530).

While these devices may function in accordance with the intentions of their designers and serve the limited purposes for which they were designed, none is perceived by the inventor herein as providing the degree of functionality and ornamentality that is required for a device to be readily acceptable to persons wanting to display their favorite sports cards and photos. As a result, a need still exists for improvements in displays and trophies for these purposes.

SUMMARY OF THE INVENTION

The present invention provides a sports card display stand designed to fulfill the aforementioned needs. The sports card display stand of the present invention provides the degree of functionality and ornamentality that is required to satisfy the high expectations of individuals wanting to store, display and protect special and rare cards and photos, especially those cards and photos of individuals participating in sports.

Accordingly, the present invention is directed to a display stand comprising: (a) a base for supporting the display stand on a support surface; (b) at least a pair of support posts mounted upright and laterally-spaced apart on the base, each of the support posts having a longitudinal groove extending between upper and lower ends of the support post and facing toward one another for slidably receiving an article holder between the posts with a pair of opposite longitudinal edges of the holder extending within the grooves; and (c) an elongated top cap member having means defined on an underside thereof for receiving in a releasable mated relationship the upper ends of the support posts in order to removably mount the top cap member on the upper ends of the support posts such that the top cap member, base and support posts together form a frame enclosing the holder while removal of the top cap member permits withdrawal and replacement of the holder from and to the grooves of the support posts.

The receiving means on the underside of the top cap member are at least a pair of spaced cavities and a longitudinal channel extending between and intersecting the cavities with the cavities and channel being recessed in the underside of the top cap member. An upper edge of the article holder extends into the recessed channel.

Also, the support posts includes a pair of end support posts and a middle support post being disposed between and spaced from the end support posts. The middle support post includes a pair of longitudinal grooves extending between upper and lower ends of the middle support post and facing in opposite directions away from one another. Further, the support posts extend in an inclined orientation relative to the base. The base also has an end portion for supporting ornamental objects in a spaced relation from the support posts.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a sports card display stand of the present invention.

FIG. 2 is an enlarged vertical sectional view of the display stand taken along line 2—2 of FIG. 1.

FIG. 3 is another enlarged vertical sectional view of the display stand taken along line 3—3 of FIG. 1 with an article holder removed.

FIG. 4A is an enlarged fragmentary sectional view of a base of the display stand of FIG. 1 showing one form of connection of a miniature replica of a baseball bat to the base.

FIG. 4B is another enlarged fragmentary sectional view similar to that of FIG. 4A showing another form of connection of the bat to the base.

FIG. 5 is a horizontal sectional view of the article holder taken along line 5—5 of FIG. 2.

FIG. 6 is a foreshortened bottom plan view of a top cap member of the display stand as seen along line 6—6 of FIG. 2.

FIG. 7 is an enlarged fragmentary top plan view of one end portion of the base of the display stand of FIG. 1.

FIG. 8 is a vertical sectional view taken along line 8—8 of FIG. 7.

DETAILED DESCRIPTION OF THE INVENTION

Figure 11:
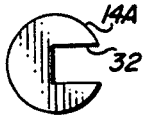
FIG. 11 is an enlarged cross-sectional view of one of the end support posts of the display stand taken along line 11—11 of FIG. 9.
Figure 10:
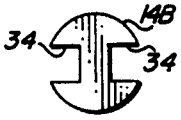
FIG. 10 is an enlarged cross-sectional view of a middle support post of the display stand taken along line 10—10 of FIG. 9.
Figure 12:
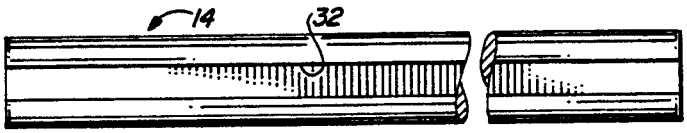
FIG. 12 is an enlarged foreshorted longitudinal view of one of the end support posts of the display stand.
Figure 9:
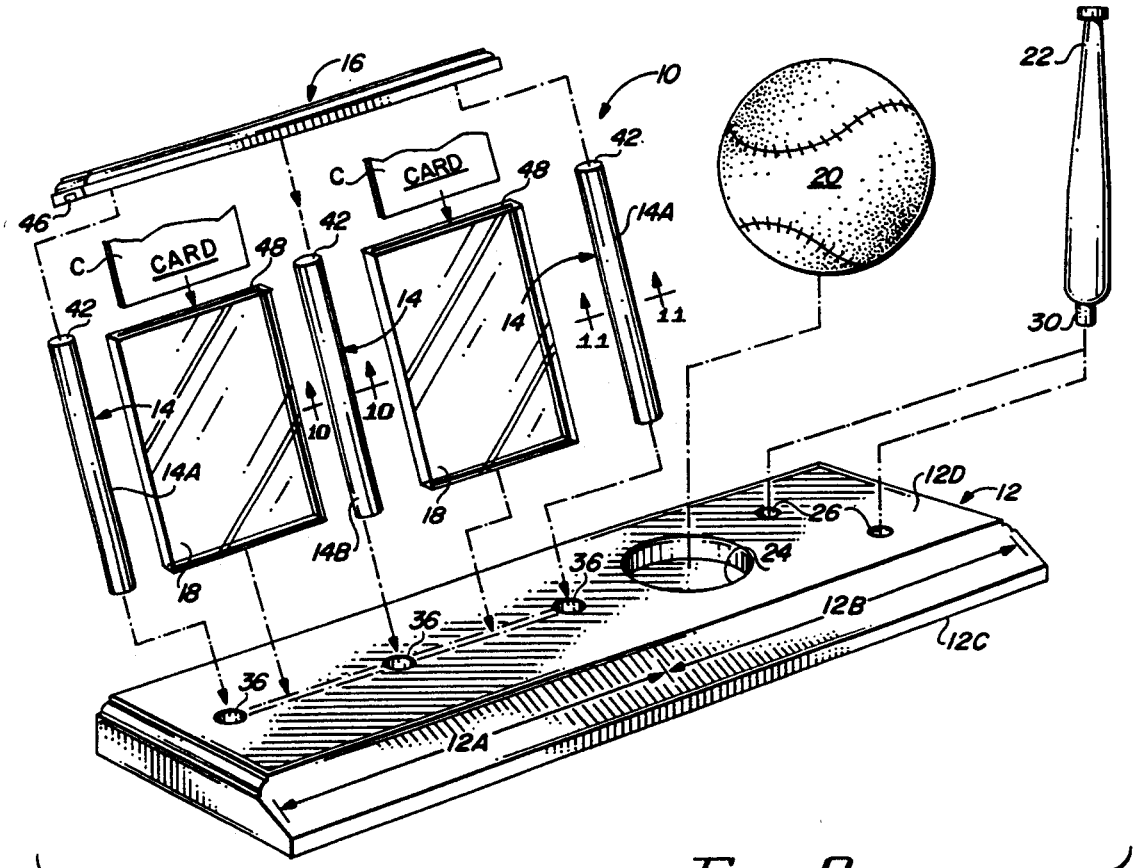
FIG. 9 is an exploded perspective view of the sports card display stand of the present invention.

Referring to the drawings, and particularly to FIGS. 1 and 9, there is illustrated a display stand of the present invention, being generally designated 10, being adapted to hold articles C such as sports cards or photos and the like. The display stand 10 basically includes a platform-like base 12 for supporting the display stand 10 on a support surface, a plurality of elongated support posts 14 mounted generally upright and laterally-spaced apart on the base 12, and an elongated top cap member 16 for fitting on the top of the support posts 14. The display stand 10 also can includes at least one article holder 18 supported between the pair of support posts 14.

Referring to FIGS. 1–4 and 7–9, the base 12 of the display stand 10 preferably is of rectangular shape and has a main display portion 12A which mounts the support posts 14 and an auxiliary display portion 12B integrally connected to and extending from the main display portion 12A which supports a selected ornaments or objects, such as a baseball 20 and a miniature replica of a pair of baseball bats 22, in a spaced relation from the support posts 14. However, within the purview of the present invention, the display stand 10 can be provided with just the main display portion 12A and thus the auxiliary display portion 12B can be omitted.

The base 12 of the illustrated display stand 10 also has a flat bottom surface 12C extending across the bottoms of the main and auxiliary display portions 12A, 12B adapting the display stand 10 to be supported on a horizontal shelf or like support structure. Further, the base 12 has a planar top surface 12D which extends across the tops of the main and auxiliary 12A, 12B. A large circular depression 24 and a pair of small circular holes 26 are formed in the top surface 12D for respectively seating the baseball 20 and connecting and fixing the bats 22 at their lower ends to the base 12 such that they are maintained in the desired upright positions, as shown in FIG. 1.

FIG. 4A shows one type of connection in the form of a screw 28 embedded in the lower end of the bat 26 for securely threadably attaching the bat 26 to the base 12. FIG. 4B shows another type of connection in the form of a plug 30 integrally attached to and projecting from the lower end of the bat 26 for fitting into one of the holes 26 for adhesively attaching the bat 26 to the base 12.

Referring to FIGS. 1, 3 and 9–12, the elongated support posts 14 of the display stand 10 are preferably cylindrical in shape, although support posts having other shapes such as rectangular could be utilized. In the illustrated embodiment, the display stand 10 has three elongated support posts 14, a pair of opposite side posts 14A and a middle support post 14B disposed between and spaced from the side support posts 14A. The side support posts 14A have respective longitudinal grooves 32 extending between upper and lower ends of the respective posts 14B and facing toward one another. The middle support post 14B has a pair of back-to-back longitudinal grooves 34 extending between upper and lower ends of the middle support post 14B and facing in opposite directions away from one another and toward the longitudinal grooves 32 in the side support posts 14B. The longitudinal grooves 32, 34 of the side and middle support posts 14A, 14B extend substantially parallel to one another for slidably receiving individual flat article holders 18 between them with opposite longitudinal edges of the holders 18 extending within the grooves 32, 34.

It should be understood that it is within the purview of the present invention to provide a display stand 10 with only a single article holder 18 by eliminating the middle support post 14B and spacing the two side support posts 14A apart from one another by a distance designed to contain the opposite longitudinal edges of the single flat holder 18. By the same token, it is within the purview of the present invention to to provide a display stand 10 with more than two article holders 18 by adding more middle support posts 14B between the two side support posts 14A and spacing the support posts 14A apart from one another accordingly.

Referring to FIGS. 3, 6 and 9, there is shown one form of connection of the support posts 14 to the base 12. As illustrated, the top surface 12C of the base 12 has a plurality of holes 36 formed therein along approximately a longitudinal centerline of the base 12 and in a spaced apart relation from one another. The lower ends of the support posts 14 extend into the holes 36 and are retained therein by use of any suitable means, such as a suitable adhesive. Preferably, the support posts 14 extend along a common plane in a rearwardly inclined orientation relative to top surface 12B of the base 12.

Referring to FIGS. 2 and 5, in the illustrated embodiment of the display stand 10, two article holders 18 are provided. Each article holder 18 preferably is in the form of a flat plastic sleeve 18 which include a pair of flat transparent sheets 38 attached at their opposite longitudinal edges 38A and unattached at their opposite upper and lower edges 38B so as to provide end openings 40 in the form of narrow slits through which articles C such as sports cards or photographs can be inserted and withdrawn.

Referring to FIGS. 1–3, 6 and 9, the elongated top cap member 16 of the display stand 10 is constructed to have a much greater length than width and thickness. The top cap member 16 has means defined on its underside 16A for receiving in a releasable mated relationship the upper ends 42 of the support posts 14. The top cap member 16 is not permanently affixed to the upper ends 42 of the support posts 14, but instead merely makes a releasable interference fit therewith permitting the top cap member 16 to be easily removed and remounted onto the upper ends 42 of the support posts 14. The receiving means on the top cap member 16 preferably is in the form of a plurality of spaced cavities 44 being recessed in the underside 16A of the top end cap member 16. The recessed cavities 44 are circular in shape, the same in number as the support posts 14 and are slightly larger in diameter than the support posts 14 for receiving the upper ends 42 of the support posts 14 in the interference fitting relationship. The receiving means on the top cap member 16 preferably also includes a longitudinal channel 46 extending between and intersecting with the cavities 44. For ease of manufacture, the channel 46 also extends to the opposite ends of the underside 16A of the top end cap 16. Like the cavities 44, the longitudinal channel 46 is recessed in the underside of the top closure member The longitudinal channel 46 has a width larger than the width of the article holder 18 and the card received in the holder 18 so that an upper edge 48 of the article holder 18 will readily extend in the channel 46. The top cap member 16, base 12 and support posts 14 having the above-described constructions together form an annular rectangular-shaped frame enclosing the article holder 18.

Lifting of the top cap member 16 to remove it from the upper ends 42 of the support posts 14 permits quick withdrawal and replacement of the article holder 18 past the upper ends of the support posts from and to the longitudinal grooves 32, 34 of the support posts 14A, 14B. The recessed cavities 44 and channel 46 are spaced from a topside 16B of the top cap member 16 such that the upper edge 48 of the article holder 18 is not exposed at the topside 16B of the top cap member 18.

Figure 13:
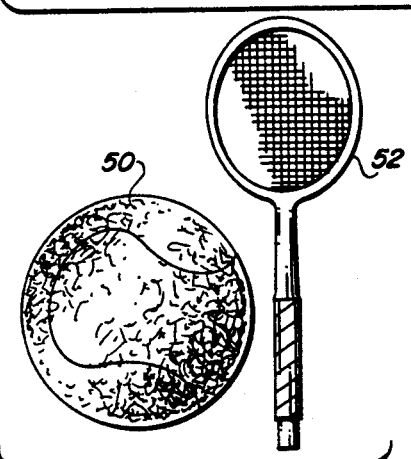
FIG. 13 is an elevational view of a tennis ball and a miniature replica of a tennis racquet which can be employed in the display stand of the present invention.
Figure 14:
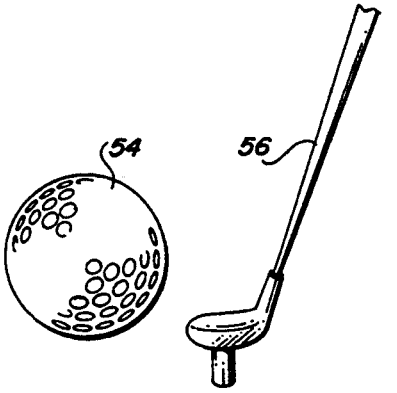
FIG. 14 is an elevational view of a golf ball and a miniature replica of a golf club which can be employed in the display stand of the present invention.

FIGS. 13 and 14 illustrate examples of combinations of other sports objects which can be employed as ornaments on the auxiliary display portion 12B of the base 12 of the display stand 10. FIG. 13 shows a tennis ball 50 and a miniature replica of a tennis racquet 52, whereas FIG. 14 shows a golf ball 54 and a miniature replica of a golf club 56. It should be readily apparent that other combinations of sports objects can be employed.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A display stand for use in supporting and displaying a flat article holder, said display stand comprising:

(a) a base for supporting said display stand on a support surface;

(b) a plurality of elongated support posts mounted upright and laterally-spaced apart on said base, said plurality of support posts including a pair of side support posts having respective longitudinal grooves extending between upper and lower ends thereof and facing toward one another, said plurality of support posts also including a middle support post being disposed between and spaced from said side support posts and having a pair of longitudinal grooves extending between upper and lower ends of said middle support post and facing in opposite directions away from one another and toward said longitudinal grooves in said side support posts, said longitudinal grooves of said side and middle support posts extending substantially parallel to one another for slidably receiving flat article holders between said posts with opposite longitudinal edges of the holders extending within said grooves; and (c) an elongated top cap member having at least a plurality of spaced cavities and a longitudinal channel extending between and intersecting with said cavities, said cavities and longitudinal channel being recessed in an underside of said top cap member for releasably receiving in an mated relationship said upper ends of said side and middle support posts and upper edges of the article holders in order to removably mount said top cap member onto said upper ends of said support posts such that said top cap member, base and support posts together form a frame which completely encloses peripheral edges of the holders while removal of said top cap member permits withdrawal and replacement of the holders past said upper ends of said side and middle support posts from and to said grooves of said support posts.

2. The display stand of claim 1 wherein said base has a main display portion mounting said support posts and an auxiliary support portion for supporting ornamental objects in a spaced relation from said support posts.

3. The display stand of claim 2 wherein said auxiliary display portion is integrally connected to and extends from said main display portion and includes means for supporting the ornamental objects thereon.

4. The display stand of claim 1 further comprising:

at least one flat article holder for receiving and holding a sports card, said flat article holder being receivable within between said posts with opposite longitudinal edges of said flat article holder extending within said grooves on said posts.

5. The display stand of claim 4 wherein said top cap member is substantially greater in length than in width and thickness.

6. The display stand of claim 4 wherein said article holder include a pair of flat transparent sheets being attached at respective opposite longitudinal edges and unattached at respective opposite upper and lower edges so as to provide end openings through which flat articles can be inserted and withdrawn.

7. The display stand of claim 1 wherein said base has a top surface with a plurality of holes formed therein along approximately a longitudinal centerline of the base and in a spaced apart relation from one another for mounting said support posts.

8. The display stand of claim 7 wherein said support posts extend with a common plane in a rearwardly inclined orientation relative said top surface of the base.

* * * * *